US005682802A

United States Patent [19]

Mazzone

[11] Patent Number: 5,682,802

[45] Date of Patent: Nov. 4, 1997

[54] WRENCH WITH MANUAL/OR ELECTRICAL CONTROL

[76] Inventor: Thomas J. Mazzone, 4016 Audubon Dr., Largo, Fla. 34641

[21] Appl. No.: 310,304

[22] Filed: Sep. 22, 1994

[51] Int. Cl.[6] ..... B25B 13/12

[52] U.S. Cl. ..... 81/127; 81/129; 81/135; 81/156

[58] Field of Search ..... 81/127, 129, 134, 81/140, 165, 135, 138, 139, 155–162, 179

[56] References Cited

U.S. PATENT DOCUMENTS

| | | | |
|---|---|---|---|
| 811,885 | 2/1906 | Webb et al. | 81/127 |
| 850,760 | 4/1907 | Kirk | 81/158 |
| 1,172,319 | 2/1916 | Sullivan | 81/127 |
| 2,499,609 | 3/1950 | Riordan | 81/135 |
| 3,290,970 | 12/1966 | De Lucia | 81/127 |
| 4,156,368 | 5/1979 | Jackson | 81/156 |
| 4,706,528 | 11/1987 | Inoue | 81/129 |
| 5,095,782 | 3/1992 | Galea | 81/129 |

FOREIGN PATENT DOCUMENTS

| | | | |
|---|---|---|---|
| 628301 | 8/1949 | United Kingdom | 81/127 |

*Primary Examiner*—Willis Little

[57] ABSTRACT

A wrench of the type having one handle produced by the manufacturing processes of drop forging and machining, incorporating a pivot point that acts as a fulcrum for a cam member that is integral with a wormwheel segment. The cam member terminates in the recess of a moveable jaw member which provides the surface for the cam to advance or retrack the jaw member toward or away from a fixed jaw that is integral with the handle member. The wormwheel is meshed with a worm gear member that can be rotated, advancing or retracking the moveable jaw member toward or away from a fixed jaw that is integral with the handle member. The worm gear member can be activated directly by hand, activated by hand through a long slender shaft connected and passing through the wormgear both of which are aligned with the longitudinal axis of the handle, by rotating a knob at the distal end of the shaft terminating near the end of the handle or activated by an assembly of electrical components in the handle member that are energized by a rechargeable battery. A slot in the recesses of the fixed jaw end of the handle translates the rotation of the integral cam and wormwheel member about the pivot point into linear components when the worm gear member rotates clockwise or counterclockwise thereby translating the moveable jaw either toward or away from the fixed jaw member.

12 Claims, 3 Drawing Sheets

WRENCH WITH MANUAL/OR ELECTRICAL CONTROL

BACKGROUND OF THE INVENTION

1. Field of the Invention

This invention relates, generally, to wrenches; more specifically, it relates to an adjustable wrench having jaws that may be locked into any desired position relative to one another by rotating a worm gear member.

2. Description of the Prior Art

Lever-actuated pivot jaw wrenches and gear actuated jaw wrenches are shown in U.S. Pat. No. 1,862,817 to Eiffel (1932); U.S. Pat. No. 2,301,918 to Peterson (1940); U.S. Pat. No. 2,280,005 to Petersen (1942); U.S. Pat. No. 2,489,895 to Kash (1949); U.S. Pat. No. 2,496,308 to Pugh (1950); U.S. Pat. No. 2,589,511 to Redmon (1952); U.S. Pat. No. 4,478,114 to Arens (1984); U.S. Pat. No. 4,884,479 to Mazzone (1989); U.S. Pat. No. 3,290,970 to De Licia (1966); and other patents as U.S. Pat. Nos. 5,239,898; 5,222,419; 5,145,103; 016,503; and U.S. Pat. No. 5,152,198.

Acknowledgment is made, herein, that petitioner of this patent is T. J. Mazzone the patentee of U.S. Pat. No. 4,884,479 which has expired. The petitioner is the sole inventor of the above patent and is the sole inventor of this patent disclosure. There are basic differences between the above cited patent and this disclosure that makes this approach unique and very novel to this particular art. The basic intent of control in or near the end of the handle is retained. The disclosures of the prior art are unique and function as revealed, but are characterized by complex constructions and many parts, making them uneconomical to manufacture and distribute, in the current commercial environment.

A perusal of the art of wrenches offers an observer several types. There are open-ended adjustable jaw wrenches, in which the gripping lands of the jaws are smooth and lands of the jaws that are serrated. There are also some wrenches wherein the jaws open in a manner parallel to the length of the handle and, alternatively, the jaws open oblique to a line perpendicular to the length of the handle. Other types of wrenches have two handles or two arms. The wrench that the petitioner is submitting for a patent is an open-end adjustable jaw type with an oblique jaw orientation.

The literature of the prior art does not lead one to new and novel concepts nor does it imbue one with the process of conceiving novel concepts that provide an exotic and practically constructed wrench capable of performing as well as the prior art.

SUMMARY OF INVENTION

The instant inventions relates to an improved wrench design in the form of a tool comprising adjustable jaws, a wormgear and a cam gear integrated together to cause the adjustable jaws to translate from proximal to distal relative positions, with a minimum number of parts in the assembly.

The novel wrench has one handle that incorporates a pivot point for the pivotal cam gear. It is unique and novel in its simplicity; in that, the handle structure embodies all its members.

The pair of adjustable jaw members are located at one end of the wrench; one of the jaws is moveable while the other has a fixed position. The moveable jaw member is an element of the assembly of parts that works in harmony as the wormgear is rotated. The axis of the wormgear is in alignment with the longitudinal axis of the handle causing the wormgear to be located appropriately to accommodate and accomplish several novel configurations.

One of these configuration involves the incorporation of a long small diameter shaft that connects to the wormgear in such a manner that allows the wormgear and the shaft to rotate in unison when the shaft is rotated by hand through the facility of a knurled boss on the end of the shaft located near the extremity of the handle. The other configuration permits the incorporation of a short shaft connection to the wormgear allowing an assembly of components consisting of a slip clutch, a flexible coupling, a reversible motor, a rechargeable battery and several electrical switches to nest within the confines and around the body of the handle. The motor is mechanically connected to the shaft with a flexible coupling and the slip clutch.

When two gears are engaged with each other there is always some backlash introduced in the assembly by virtue of the gearing unless something is done to counter this problem. A spring has been placed at one end of the wormgear to minimize the backlash between the cam gear and the wormgear. The spring helps to keep the surfaces of the meshing gear parts in direct contact with each other.

A primary object of this invention is to provide a wrench of the adjustable jaw type that is safe and easy to use because the operator thereof need not place fingers near the jaws in order to close or open them.

A secondary object of this invention is to provide uniformity of opening and closing the jaws when the handle is rotated or flipped to obtain increased leverage when applying it to tighten or loosen a nut.

An important object of this invention is also to provide an adjustable jaw wrench of simple, easy to use, and long lasting design. Another advantage of this wrench is to provide a means to control the adjustment of the jaws when working in very close and narrow spaces where a hand cannot enter to manually adjust the position of the jaws.

The invention accordingly comprises the features, combination of elements, and arrangement of parts that will be exemplified in its construction as hereinafter set forth. The scope of the invention will be indicated in the claims.

BRIEF DESCRIPTION OF THE DRAWINGS

To obtain a better understanding of the nature and objects of the invention, reference should be made to the following detailed description, taken in connection with the accompanying drawings, in which.

In order to be consistent with the numbering, similar reference numerals refer to similar parts throughout the several views of the drawings.

DETAILED DESCRIPTION OF A PREFERRED EMBODIMENT

Figure 3:
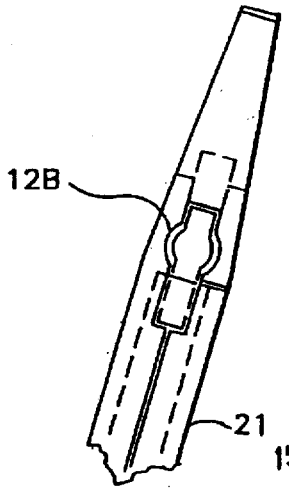
FIG. 3 is a partial view of the left side of FIG. 1. This reveals the fixed jaw on the left of the elevational view.

First, reference will now be made to FIG. 1, wherein it can be seen that the illustrative embodiment of the invention is denoted by the reference numeral 12 as a whole.

Wrench 12 is shown with its jaws in their fully closed position and in their fully separated position (in phantom lines).

The main handle portion 12A is integral with a fixed jaw 14 and serves as the base means of the inventive assembly. A moveable cam member 15 is pivotally mounted to the main body of wrench 12 at its fulcrum point with a screw 25, thereby functioning as a lever means. The cam member 15 has a gear portion 15A and a lever portion 15B. Since screw member 25 is a fulcrum for cam means 15, the fulcrum point divides the wrench into a proximal portion 15A and a distal portion carrying lever arm 15B remotely therefrom.

The lever arm portion 15B of the cam 15 is nested between two fingers 13A and 13B of movable jaw 13. Jaw member 13 is captivated within a channel 12B internal to the body of wrench 12, extending along an axis substantially transverse to the longitudinal axis of the wrench.

Figure 4:
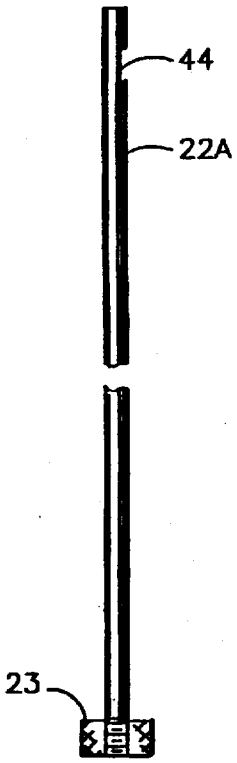
FIG. 4 depicts the long slender shaft and knurled boss.
Figure 1A:
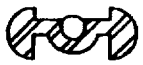
FIGS. 1A–1F show sectional views of how the shaft interweaves through slots in the forged handle as viewed in the direction of arrows 1—1 to 6—6, respectively, in FIG. 1.
Figure 1B:
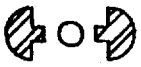
Figure 1C:
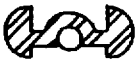
Figure 1D:
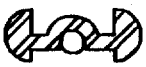
Figure 1E:
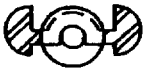
Figure 1F:
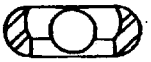
Figure 7:
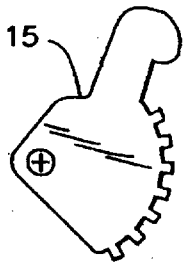
FIG. 7 and FIG. 7A respectively show front and side views of the cam gear having an integral segment portion and pivot hole.
Figure 7A:
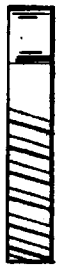

Cam member 15, pivotally mounted, meshingly engages with wormgear member 16 which is mounted within an aperture of wrench 12 and is aligned with the longitudinal axis of the handle. Wormgear member 16 is captivated within the aperture and affixed to shaft member 19 by a set screw member 17, whose forward tip impinges on a flat surface similar to that shown by surface 44 of FIG. 4.

A spring member means 18 is assembled between the inner diameter of the lower end of the worm and the shaft member 19 to minimize backlash. The shaft member is prevented from upward movement by a set screw member 20. Shaft member 19 is shown connected to a long slender shaft member 22. The ends of shaft member 19 and shaft member 22 engage each other through square surfaces as shown by shaft ending 28. Shaft member 22 is shown held in the engaged position by a set screw member 24 that can be adjusted to retract away from the knob member 23, so that shaft member 22 can be disengaged from shaft 19 if so desired. The handle is threaded as shown by surface element 27 where the set screw is located.

Figure 1:
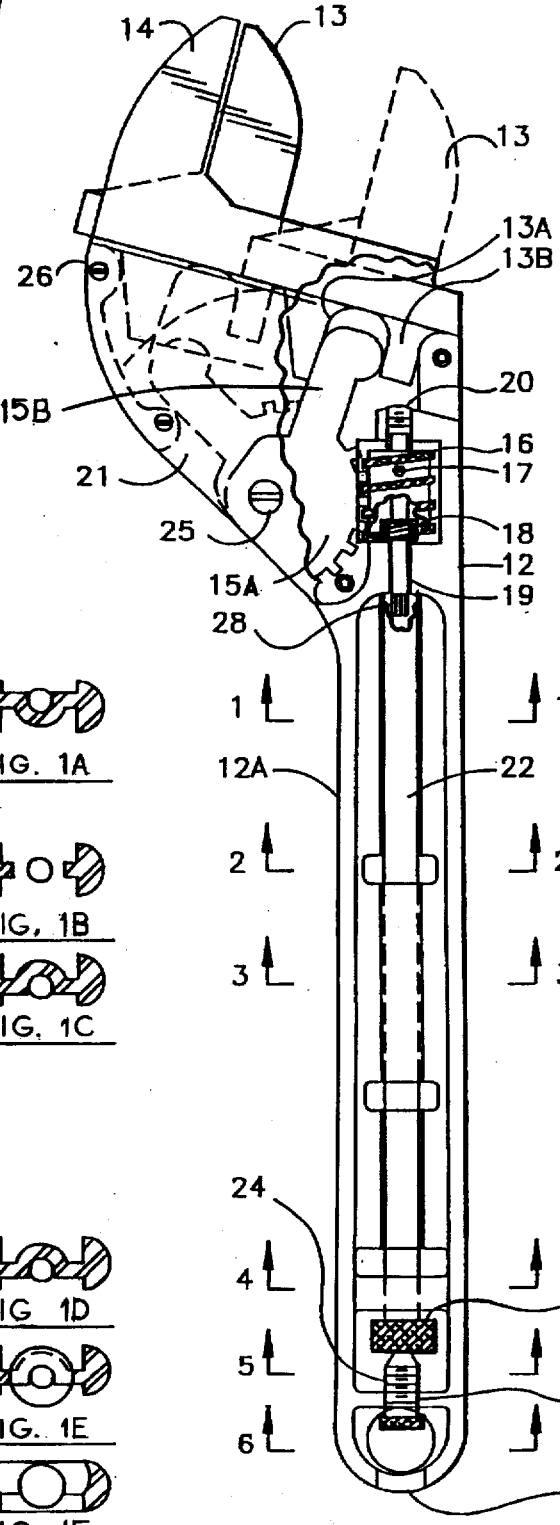
FIG. 1 is an elevational view of the novel wrench, showing its jaws in the separated (phantom lines)and closed configuration. The elevational view shows cross-sections of the handle.
Figure 2:
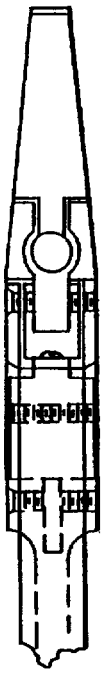
FIG. 2 is a view of the moveable jaw side of the wrench (the right side). Here, one can see that the cover is located on the left side of the view and held in place by screws.

Referring to FIG. 1, when wormgear member 16 is rotated to the left, manually or through the long shaft member 22, wormgear member 16 and cam member 15 will rotate to the left engaging the finger 13A of member 13, moving the adjustable jaw to the left. If wormgear member 16 is rotated to the right from a closed position, the wormgear and cam member 15 will rotate to the right with the cam surface engaging the finger 13B of adjustable jaw member 13, moving the jaw to the right. In FIG. 3, the channel element 12B, of the wrench converts the circular motion of the cam member 15 to linear motion of the movable jaw 13 in either direction, right or left.

Worm gearing with a small helix angle in the range of 3 or 4 degrees to 8 or 9 degrees can be self locking and are usually highly leveraged. Therefore, when a large force is imposed upon the jaw member 13 from movement by wormgear 16, an object between the jaws 13 and 14 is held in a very tight grip, since the wormwheel cannot drive the worm backwards. Element 29 at the extreme end of the handle in FIG. 1 shows a bend in the handle and means for the bridging element above it to be drilled and tapped, allowing the assembly of the set screw member 24.

FIGS. 1A–F show how the handle is fabricated and how the shaft member 22 is held in place by the opposing lands of the inner section of the handle.

Figure 6:
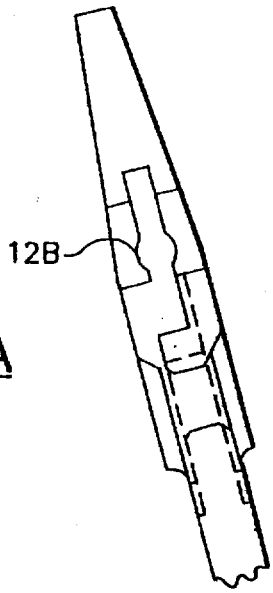
FIG. 6 is simply a partial view of the left side of FIG. 5 showing the slot for retaining the adjustable jaw in place.
Figure 8:
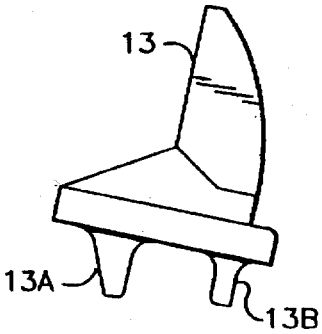
FIG. 8 and FIG. 8A show the front and side views of the adjustable jaw respectively with fingers 13A and 13B.
Figure 8A:
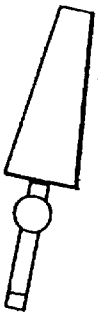
Figure 5A:
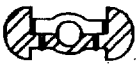
FIGS. 5A–5B how a cross-sectional view of the end of the handle to permit the assembly of the shaft in the handle viewed in the direction of arrows 7—7 and 9—9, respectively, in FIG. 5.
Figure 5B:
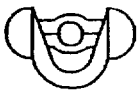
Figure 5:
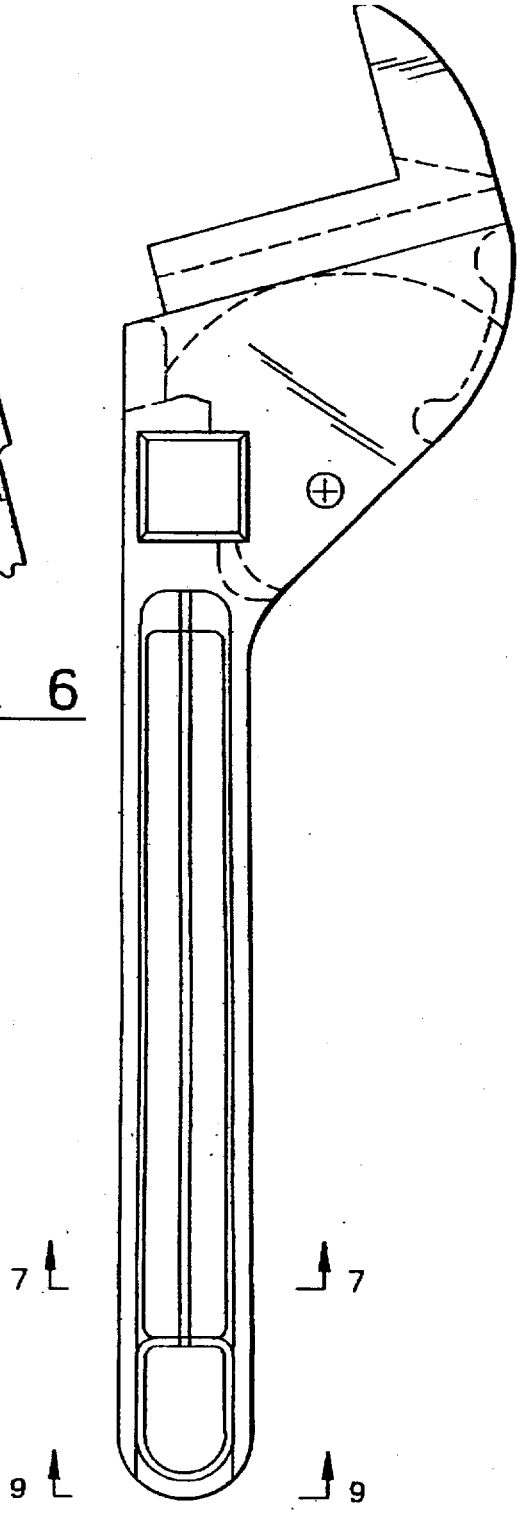
FIG. 5 shows a forged handle configuration where the handle itself is not slotted but designed to allow, as an alternative, a second forging to be staked to the handle, thus, providing a hole for supporting a long slender shaft. Also this figure shows an aperture for nesting a wormgear.

FIG. 5 and 6 show the general features of the fixed jaw end of the handle after forging and machining of the channel element 12B. FIGS. 5A and 5B show the handle end with an optional design for providing a support for the shaft assembly 22A shown in FIG. 4. The top section of FIG. 5A can be a forging or a stamping attached to the basic handle to provide a long hole for the shaft. FIG. 5B shows the handle end 29 permitting the installation of the shaft assembly 22A.

Figures 9, 9A, 10, 11:
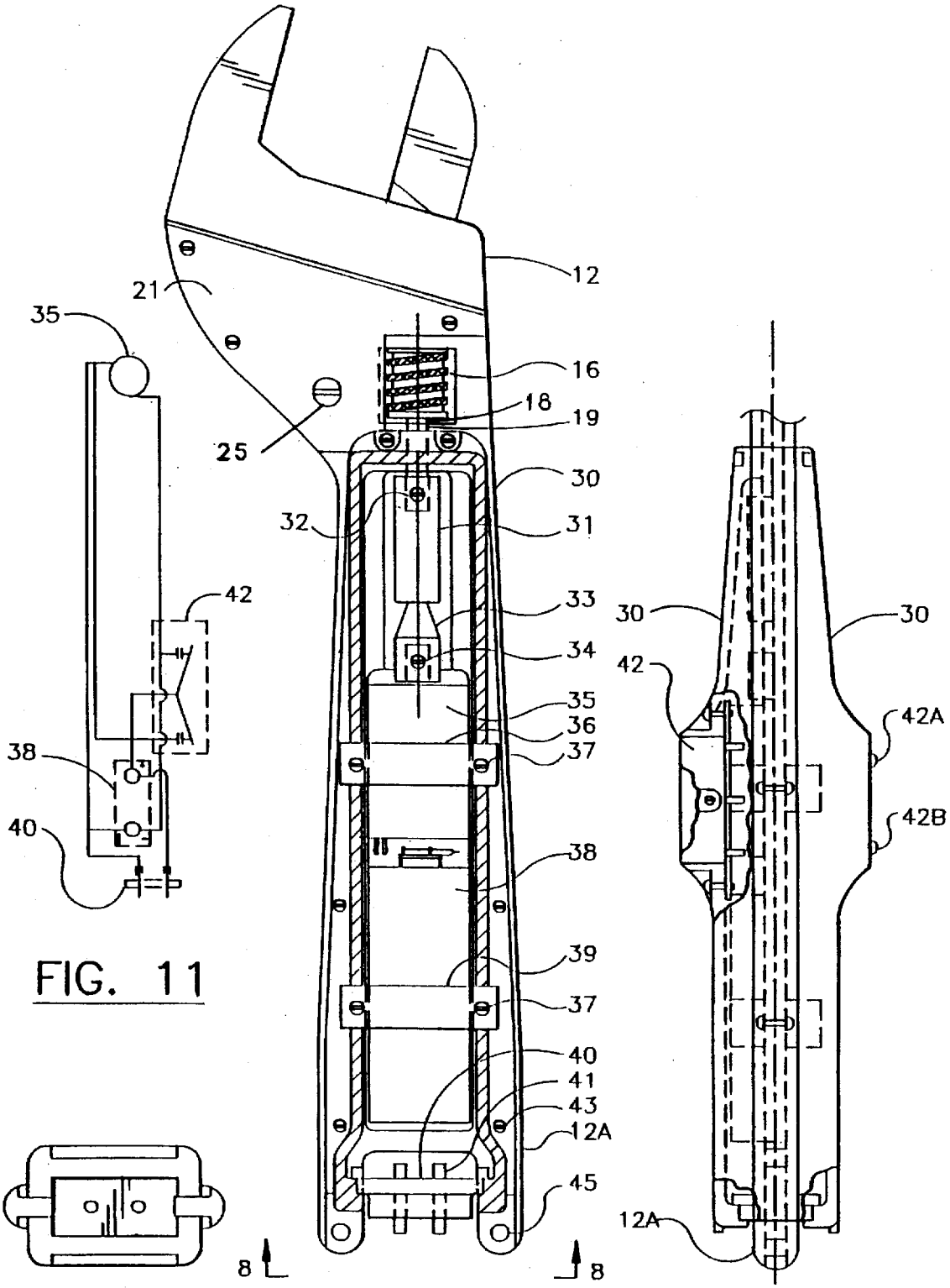
FIG. 9 shows the elevational view of the wrench with a cut-away of the handle exposing the assemblage of mechanical and electrical components that nest therein.
FIG. 9A shows the cross-sectional rear of the handle viewed in the direction of arrows in FIG. 9 and provides a look at the terminal arrangement for recharging the battery in the handle.
FIG. 10 is a right side view, cut-off, of the handle of FIG. 9 showing its contours and an exposed view of one electrical switch, since only one switch is needed to make it operate.
FIG. 11 shows an electrical schematic for the wiring of electrical components comprising the instant invention shown in FIGS. 9 and 10.

FIG. 9 illustrates wrench 12 as a whole with the same jaw actuation members 16, 15, 13, and pivot point member 25. Spring member 18 and shaft member 19 also make up a part of the assembly. The cover member 21 together with the said handle member incorporate the said pivot point as shown in FIG. 1.

The optional handle, member 12*a*, in FIG. 9 is ribbed and has a cavity in the central area providing the space needed for the components therein, and giving it the structural integrity to perform its intended function.

Now the functions of the components within the handle member 12A will be described. Slip clutch member 31 is connected to shaft member 19 with set screw means 32. The slip clutch is a means to prevent overdriving the jaws in either direction and of preventing damage to the motor 35. The motor is a reversible member and is connected to slip clutch member 31 by flexible joint member 33 with set screw means 34. The flexible joint is not only a connecting point, but also, a means of allowing some misalignment between the motor means 35 and shaft 19. The motor is attached to the handle frame 12A by strap member 36 with screw members 37.

A rechargeable battery 38, provided for energizing the motor member 35, is held in position with strap members 39 and screw members 37. The battery 38 is wired to the motor 35, the switches and the two terminals 41 at the end of the handle. The terminals are a means for charging and recharging the battery 38 and are parts of assembly member 40.

Although two switches 42A and 42B are shown in FIG. 10, only one switch is needed to energize the motor 35. These switch buttons will energize the motor to rotate in contra directions. Two holes in the said handle structure, indicated by member 45, provide a means for hanging up the wrench on a hook. The end of the handle is depicted by FIG. 9A.

FIG. 11 shows the electrical schematic for wiring the motor 35, the battery 38, terminal board 40, and the switch 42. The terminal board assembly 40 is retained in position since it is captured between the plastic cover member 30, as shown in FIG. 10, and attached to the handle frame with screw means 43.

What is claimed is:

1. An adjustable wrench comprising:

a handle member, said handle member having a fixed position jaw formed on its proximal end;

an aperture formed in said handle;

a wormgear member nested in said aperture with the longitudinal axes of the said wormgear and handle being coincidentally aligned;

a movable jaw disposed in the proximal end of said handle cooperating with said fixed jaw, said movable jaw having a rearward portion forming a cam follower;

cam means pivotally attached to said handle;

a gear portion formed on the distal end of said cam means and intermeshed with said wormgear; and a lever arm portion formed on the proximal end of said cam means and having a camming surface engaging said cam follower to actuate the movable jaw member as the wormgear is rotated; a cavity in said handle member for receiving the assemblage of the gear portion of said cam means, pivotally, to the said worm gear therein.

2. The wrench of claim 1, further comprising:

a channel means oblique to the longitudinal axis of said handle member extending from and through said fixed jaw means to the opposite side of said handle member for allowing said movable jaw member to travel therein; a cavity in said handle member for receiving the assemblage of the gear portion of said cam means, pivotally, to the said worm gear therein.

3. The wrench of claim 1 wherein, said wormgear member is fixedly connected to a first shaft member whose axis is aligned parallel and coincident to the longitudinal axis of the handle member; and a spring member carried by said shaft for the purpose of minimizing backlash between said wormgear member and said cam gear portion.

4. The wrench of claim 3, further comprising:

a second shaft member with a knob recessed at one end and internal flat surfaces at the opposite end, said internal flat surfaces engaging an end of the first shaft member.

5. The wrench of claim 4, further comprising:

a series of apertures located along the length of the handle, said apertures having therebetween alternating semicircular opposing ribs concentric with its longitudinal axis, creating entry port means for supporting said first and second shaft members.

6. The wrench of claim 4, wherein the distal end of said handle member comprises a threaded cross rib having an adjustable set screw to allow said second shaft member to engage or disengage said first shaft member, said shaft members having mating flat surfaces engaging each other.

7. The wrench of claim 6, wherein the distal end of said handle member is formed off-center to allow passage of said shaft members and said set screw member threadingly into said apertures.

8. The wrench of claim 6, wherein said first shaft member is fixedly engaged by a set screw to the center hole of said wormgear member, whereby, rotation of the knob at the opposite end of the said shaft member actuates the said movable jaw member.

9. The wrench of claim 1, wherein said handle member further comprises:

a torque limiting slip clutch connected to the wormgear to prevent overdriving the jaws in either direction;

a reversible motor connected to the slip clutch member by a flexible joint member, said flexible joint allowing misalignment between the motor and wormgear;

a rechargeable battery connected to switch means and said motor for energizing said motor.

10. The wrench of claim 9, wherein said wormgear, flexible joint member, slip clutch member, and motor are connectively attached, each to the other, and coaxially aligned with the axis of the said wormgear member.

11. The wrench of claim 10, wherein the said handle member has two stubs at its distal end, each having an aperture means for hanging the wrench on a hook; and non-conductive cover means on the opposite faces of said handle member.

12. The wrench of claim 9, wherein said gears between said motor and said movable jaw comprise reduction gears.

* * * * *